US005791279A

United States Patent [19]

Hart

[11] Patent Number: 5,791,279

[45] Date of Patent: Aug. 11, 1998

[54] APPARATUS FOR MANUALLY TRANSPORTING A CANOE

[76] Inventor: David Hart, 4265 Jefferson St., Excelsior, Minn. 55331

[21] Appl. No.: 657,037

[22] Filed: May 30, 1996

[51] Int. Cl.[6] ..... B60P 3/10

[52] U.S. Cl. ..... 114/344; 280/47.131; 114/347

[58] Field of Search ..... 114/343, 344, 114/347; 280/414.2, 47.131; 405/1

[56] References Cited

U.S. PATENT DOCUMENTS

| | | | |
|---|---|---|---|
| 3,119,127 | 1/1964 | Taggert | 114/344 |
| 3,462,781 | 8/1969 | Olvera | 114/344 |
| 3,567,241 | 3/1971 | Foschino | 280/414.2 |
| 4,392,665 | 7/1983 | Miller et al. | 114/344 |
| 4,936,595 | 6/1990 | Cunningham | 114/344 |

FOREIGN PATENT DOCUMENTS

| | | | |
|---|---|---|---|
| 2176750 | 1/1987 | United Kingdom | 114/344 |

*Primary Examiner*—Ed L. Swinehart
*Attorney, Agent, or Firm*—Hugh D. Jaeger

[57] ABSTRACT

A self-stowing canoe transporting apparatus which enables manual transport of a canoe over rough terrain in an upright position. The transporting apparatus includes a dual-wheeled dolly with a cradle having contoured constrained abutment portions which support the aft bottom or keel of a canoe. The transporting apparatus is attachable to the canoe without drilling, welding, use of adhesives, or any form of modification of the canoe. The dolly is pivotally attached at the stern of the canoe enabling rotational motion of the dolly to an aft deck stowage position during use of the canoe on the water. In portaging, the cradle rotates under the canoe, and secure engagement of the cradle with the canoe aft bottom or keel is accomplished with tensioning straps.

7 Claims, 3 Drawing Sheets

APPARATUS FOR MANUALLY TRANSPORTING A CANOE

CROSS REFERENCES TO CO-PENDING APPLICATIONS

None.

BACKGROUND OF THE INVENTION

1. Field of the Invention

The present invention relates to a manual canoe portaging apparatus, and more particularly, the present invention relates to a wheeled self-storing canoe transporting apparatus for manual wheeled transport of a canoe over land.

2. Description of the Prior Art

Canoes and other small watercraft are often used on urban and remote bodies of water in situations which require the craft to be manually transported over land. Many inventions have been put forth to expand upon existing methods of overland transport of small watercraft by modifying yoke carrying systems. Numerous devices have been proposed to accomplish this task using aft and stern carrying points such as lashed paddles, hinged poles, etc., as disclosed in U.S. Pat. Nos. 5,127,356, 4,850,296, 4,804,123 and 4,641,874. Wheeled devices are also disclosed to accomplish the same function, as disclosed in U.S. Pat. Nos. 5,261,680, 5,203,580, 4,936,595 and 4,824,127.

SUMMARY OF THE INVENTION

The goal of the present invention is to provide a means of manually transporting a small watercraft from one body of water to the next with the least expenditure of physical energy. It is thus an object of the present invention to provide transporting apparatus for a canoe that enables a single person to move the canoe.

Another object of the present invention is to provide a pivoting wheeled dolly that is uniquely stowable and engageable so as to allow the operator to go from water to land to water with minimal physical exertion.

Another object of the present invention is to provide transporting apparatus which enables the canoe to be transported upright without removing cargo.

Another object of the present invention is light-weight construction which enables the canoe to be portaged inverted overhead with the transporting apparatus attached without appreciable increase in load.

Another object of the present invention is to provide stowable wheeled dolly attachment capability without drilling, welding, use of adhesives, or any form of canoe modification.

Another object of the present invention is to provide stabilized inverted on-land canoe storage where the dolly wheels act as stabilizers when in stowed position.

Briefly described, a canoe transporting apparatus is provided comprising a wheeled dolly including a cradle with contoured constrained abutment portions which support the aft bottom or keel of a canoe. Incorporated pivoted support at the stern enables rotation of the dolly onto the aft deck, creating ease of stowage during water use.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
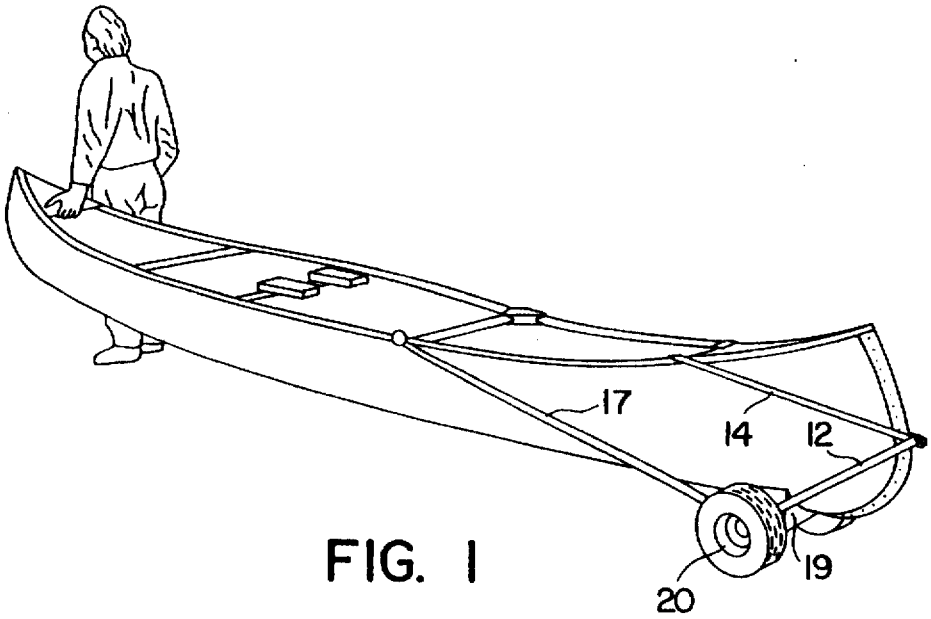
FIG. 1 illustrates a perspective view of the transporting apparatus depicting an overland portaging mode.

Illustrated in FIG. 1 is a canoe equipped with the transporting apparatus constituting the present invention. As shown, the transporting apparatus includes wheels which support the stern of the canoe and enable the canoe to be transported over land by lifting the bow of the canoe and pulling the canoe along the ground.

Figure 2:
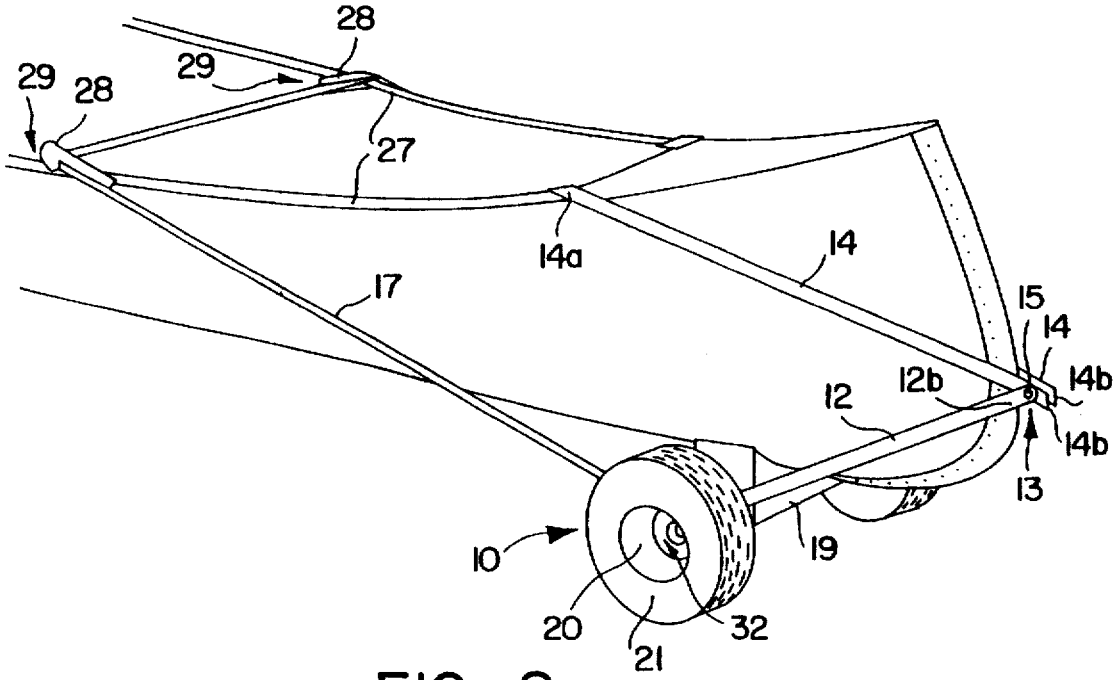
FIG. 2 illustrates a perspective view of a canoe stern with the transporting apparatus attached.
Figure 4:
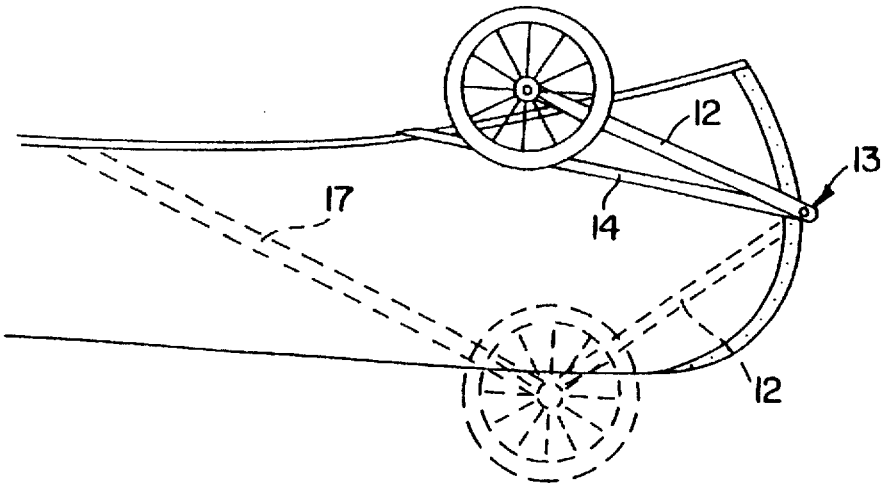
FIG. 4 illustrates a side view of a canoe with the transporting apparatus in the stowed position.

As shown more clearly in FIG. 2, the transporting apparatus includes a wheeled dolly 10 which consists of an axle 18, a cradle 19 for receiving the keel of the canoe, and two wheels 20. The wheels 20 preferably are of the sealed bearing type and include tires 21 which are preferably pneumatically inflated tires. Although the wheels are depicted in FIG. 2 as being of the spokeless variety, they may be of the spoked variety, as shown in FIG. 4. Similarly, different varieties of cradles can be used. The cradle 19 illustrated in FIG. 2 is a composite construction composed of glass fiber laminates with a foam core for built-in buoyancy, and includes constrained abutment portions, as shown more clearly in FIG. 5, which support the aft bottom or keel of the canoe. Alternatively, a cradle constructed of formed sheet metal, such as aluminum, and shaped as illustrated at 19A in FIG. 6 can be employed. The cradle 19 (or 19A) is mounted on the mid portion of the axle 18, and the wheels 20 are mounted to each end of the axle 18. The axle 18 is generally of sufficient length that upon mounting the wheels 20 to each end thereof, the canoe can be supported on the cradle 19 (or 19A) without interference from the hull of the canoe with either tire 21.

Figure 3:
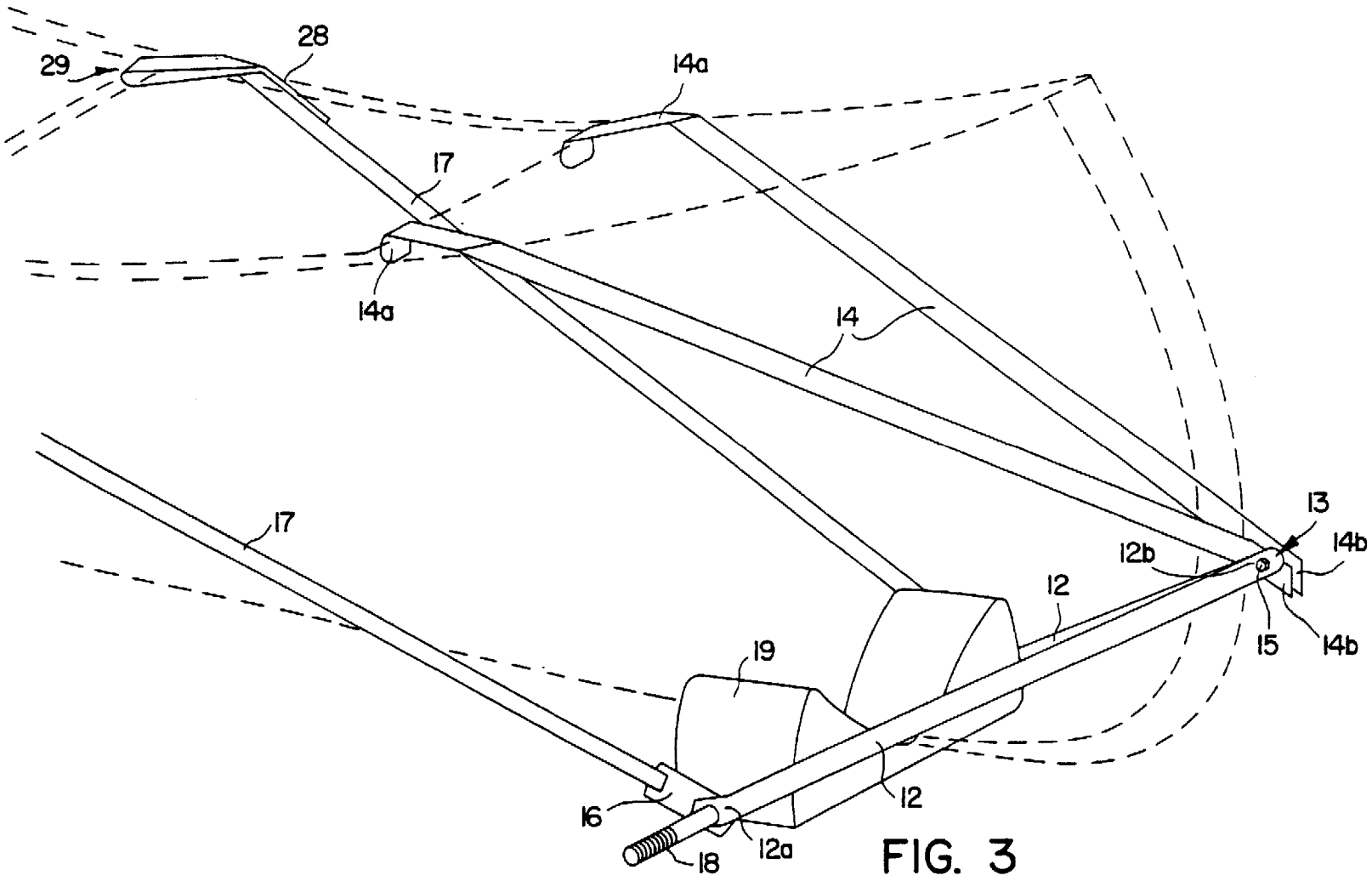
FIG. 3 illustrates a perspective view of the transporting apparatus with the wheels removed and showing attachment of all linkages.

With reference now to FIG. 3, yet still noting FIG. 2, additional elements and all linkages of the transporting apparatus are next described. The wheels shown in FIG. 2 have been omitted from FIG. 3 for clarity and ease in illustrating other parts. As shown, the transporting apparatus further includes a frame comprising a pair of first members or ties 12,12 each having a first end **12*a* and a second end 12*b*, and a pair of second or clinching members 14,14 each also having a first end 14*a* and a second end 14*b*. The first ends 12*a*,12*a* of the first members 12,12 are attached to the axle 18 on opposite sides of the cradle 19. These ends 12*a*,12*a* are drilled to accept the axle 18, as shown in FIG. 3. The first ends 14*a*,14*a* of the second members 14,14 are bent or otherwise formed for engagement with or attachment to the opposite gunwales 27,27 of the canoe at the furthermost aft canoe thwart or to the furthermost aft canoe thwart itself. The second ends 12*b*,12*b* of the first members 12,12** and the second ends 14*b*, 14*b* of the second members 14,14 are all attached together at a pivot point 13 by means of a throughbolt or pin 15 with appropriate locking mechanism. Tensioning strap end attachment members 16,16 attach to axle 18 on opposite sides of the cradle 19, and adjustable tensioning straps 17,17 extend from the tensioning strap end attachment members 16,16 to midcraft thwart attach points 29,29 to provide positive frictional engagement of the cradle 19 with the keel of the canoe. The tensioning strap end attachment members 16,16 are drilled at one end to accept the axle 18. The tensioning strap end attachment members 16,16 and to the thwart at attach points 29,29 in a variety of manners. In the preferred embodiment, each tensioning strap 17 is looped through a slot in a tensioning strap end attachment member and then permanently attached to itself. The thwart attach end of each tensioning strap 17 is looped around the midcraft thwart and attached to itself by means of a hook-loop fastener strip 28 provided on the end thereof, as shown in FIG. 3. At each attach point 29, sufficient tension is applied to the tensioning strap 17 to create positive constraint of the cradle 19 by means of frictional force between the cradle 19 and the hull of the canoe.

Figure 5:
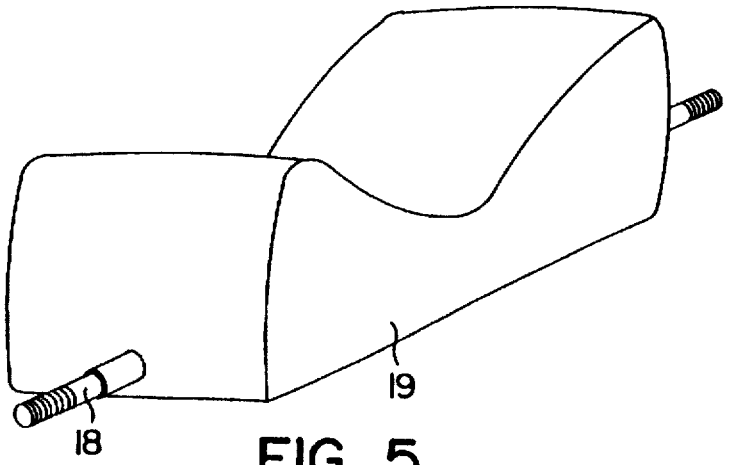
FIG. 5 illustrates a perspective view of an axle and cradle assembly wherein the cradle is made of composite materials for buoyancy; and, FIG. 6 illustrates a perspective view of an axle and cradle assembly wherein the cradle is made of formed metal sheet.
Figure 6:
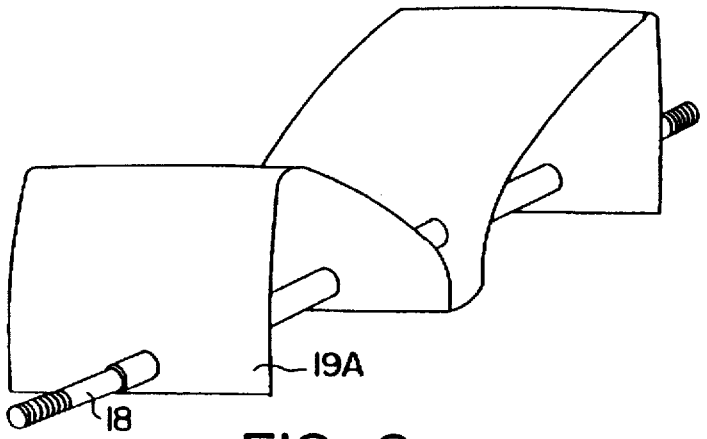

The two previously mentioned varieties of cradles are shown in FIGS. 5 and 6. In FIG. 5, a foam/fiberglass composite cradle 19 is shown as being fabricated around an axle 18 so as to be unitary therewith. In FIG. 6, a cradle 19A is shown as being formed from metal sheet and fitted to the axle 18. In both embodiments wheels attach to the axles 18 on outer reduced diameter shafts with positive lock castle nuts 32 (see FIG. 2). Alternate attachment mechanisms for the wheels, such as washer/cotter pin, may be used.

When in the act of transporting a canoe over land, the transporting apparatus is in the position illustrated in FIGS. 1 and 2 with the wheels 20 of the dolly 10 engaging the ground and with the tensioning straps 17,17 tensioned and secured at attach points 29,29. When the canoe arrives at its destination and is to be placed in the water, the tensioning straps 17,17 are released from the attach points 29,29 and the dolly 10 composed of axle 18, cradle 19, and wheels 20 is pivoted along with members 12,12 about pivot point 13 along the plane of the vertical centerline of the canoe to the stowage position on the aft deck of the canoe, as illustrated in FIG. 4. If it is at any time desired to stow the canoe on land, the canoe and transporting apparatus can be inverted from the position shown in FIG. 4 so that the wheels engage the ground and serve as stabilizers for a stowed position.

It is thus seen that a simple, yet elegant, apparatus for manually transporting a canoe has been provided which attaches to the canoe without the need for any modification of the canoe and which attains all of the objects of the invention enumerated above.

Various modifications and alterations can be made to the transporting apparatus constituting the invention without departing from the central spirit thereof. For example, the first and second members 12,12 and 14,14 may be made adjustable in length to accommodate different sizes and styles of canoes. Therefore, it is to be understood that the foregoing description is given by way of example only, and that the invention is limited only as defined by the following claims.

APPARATUS FOR MANUALLY TRANSPORTING A CANOE

PARTS LIST

10 dolly or wheeled dolly
12 first member or tie

12*a* first end (of first member)
12*b* second end (of first member)
13 pivot point
14 second member or clinching member
14*a* first end (of second member)
14*b* second end (of second member)
15 throughbolt or pin
16 tensioning strap end attachment member
17 tensioning strap
18 axle
19 cradle
19A cradle
20 wheel
21 tire
27 gunwale
28 hook-loop fastener strip
29 attach point
32 castle nut

I claim:

1. An apparatus for manually transporting a canoe, comprising:

a. a dolly having an axle, wheels, and a cradle on which the canoe hull is adapted to be received and supported;

b. a frame adapted to be mounted on the stern of the canoe, said frame comprising (i) a pair of first members, each first member having first and second ends, said first ends being attached to said axle on opposite sides of said cradle, and said second ends being pivotally joined together at a pivot point, and (ii) a pair of second members extending generally longitudinally from said pivot point, each second member having a first end adapted to be engaged to a gunwale or thwart of the canoe and a second end attached to said pivot point; and, c. a pair of tensioning straps, each tensioning strap having a first end adapted to be attached to a canoe thwart and a second end extending to said axle on either side of said cradle.

2. The apparatus of claim 1, wherein said pivot point is a single bolt/pin extending through said second ends of said first and second members.

3. The apparatus of claim 1, wherein the frame, the dolly, and the tensioning straps enable the canoe to be transported manually by lifting the canoe bow while the remainder of the canoe remains supported by the wheels, axle, and cradle of the dolly.

4. The apparatus of claim 1, wherein the dolly may be pivoted around said pivot point, along the plane of the canoe vertical centerline, to a stowage position on the aft deck of the canoe.

5. The apparatus of claim 1, wherein the cradle is made of formed metal sheet.

6. The apparatus of claim 1, wherein the cradle is of composite construction of fiber laminates with foam core, for built-in buoyancy.

7. The apparatus of claim 1, wherein said dolly and frame can be attached to a canoe without drilling, welding, use of adhesives, or any form of modification of the canoe.

* * * * *